US010553970B2

(12) United States Patent
Tamai

(10) Patent No.: US 10,553,970 B2
(45) Date of Patent: Feb. 4, 2020

(54) ELECTRICAL CONNECTOR FOR CIRCUIT BOARDS

(71) Applicant: Hirose Electric Co., Ltd., Shinagawa-ku, Tokyo (JP)

(72) Inventor: Nobuhiro Tamai, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 16/287,996

(22) Filed: Feb. 27, 2019

(65) Prior Publication Data

US 2019/0267733 A1 Aug. 29, 2019

(30) Foreign Application Priority Data

Feb. 28, 2018 (JP) ..... 2018-034385

(51) Int. Cl.
*H01R 12/00* (2006.01)
*H01R 12/71* (2011.01)
*H01R 13/648* (2006.01)

(52) U.S. Cl.
CPC ..... *H01R 12/712* (2013.01); *H01R 13/648* (2013.01)

(58) Field of Classification Search
CPC ..... H01R 12/712; H01R 13/659; H01R 12/7082; H01R 24/60; H01R 13/6594; H01R 12/721; H01R 13/648
USPC ..... 439/62
See application file for complete search history.

(56) References Cited

U.S. PATENT DOCUMENTS 5,800,186 A * 9/1998 Ramirez ..... H01R 12/721 439/74
6,234,841 B1 * 5/2001 Chang ..... H01R 13/659 439/607.25
9,478,924 B2 * 10/2016 Tamai ..... H01R 24/60
10,283,913 B2 * 5/2019 Takeuchi ..... H01R 13/6594
2015/0079819 A1 * 3/2015 Tamai ..... H01R 12/7082 439/101

FOREIGN PATENT DOCUMENTS

JP 6198712 B2 9/2017

* cited by examiner

*Primary Examiner* — Jean F Duverne
(74) *Attorney, Agent, or Firm* — Procopio, Cory, Hargreaves & Savitch LLP

(57) ABSTRACT

The terminals have a connecting portion, formed at one end in the direction of connection of the connector and is connected to a mounting face of a circuit board, and a contact portion, formed at the other end in the above-mentioned direction of connection and has a contact surface brought in contact with a counterpart terminal; the ground plate has resilient strips, which are brought in contact with the above-mentioned terminals; said resilient strips are formed within the range of the above-mentioned contact portions in the above-mentioned direction of connection at locations corresponding to the above-mentioned terminals and are brought in contact with the surface of said terminals on the side opposite to the above-mentioned contact surface; and the above-mentioned terminals have retained portions that extend from the lateral edges of the above-mentioned contact portions extending in the above-mentioned direction of connection and are secured in place by the retainer.

5 Claims, 9 Drawing Sheets

ELECTRICAL CONNECTOR FOR CIRCUIT BOARDS

CROSS REFERENCE TO RELATED APPLICATIONS

This Paris Convention Patent Application claims benefit under 35 U.S.C. § 119 and claims priority to Japanese Patent Application No. JP 2018-034385, filed on Feb. 28, 2018, titled "ELECTRICAL CONNECTOR FOR CIRCUIT BOARDS", the content of which is incorporated herein in its entirety by reference for all purposes.

BACKGROUND

Technical Field

The present invention relates to an electrical connector for circuit boards that is disposed on a mounting face of a circuit board and has a counterpart connector connected thereto in a direction of connection perpendicular to said mounting face.

Background Art

In electrical connectors for circuit boards having multiple terminals arranged in a single direction parallel to a mounting face of a circuit board, there is sometimes provided a ground plate extending over the array range of said multiple terminals. If some terminals among said multiple terminals are ground terminals, an improved shielding effect can be obtained by bringing a portion of the above-mentioned ground plate in contact with the ground terminals.

Known connectors of this type include the circuit board connector described in Patent Document 1. For example, the electrical connector for circuit boards described in Patent Document 1, which is a plug connector, is configured such that multiple connector elements, which are arranged in a single array direction parallel to the mounting face of a circuit board, are coupled with the help of a coupling member extending in said array direction. Each connector element has multiple terminals that extend such that their longitudinal direction is the direction of connection (vertical direction) perpendicular to the above-mentioned mounting face and that are arranged in the connector-width direction, a ground plate that extends over the array range of said terminals, and a housing that secures in place said multiple terminals and ground plate. Some terminals among the above-mentioned multiple terminals are used as ground terminals.

In the terminals, a connecting portion connected to the above-mentioned mounting face is formed at one end in the above-mentioned direction of connection and a contact portion brought in contact with a counterpart connector is formed at the other end, with said connecting portions and said contact portions coupled using retained portions secured by the housing. Throughout its entire vertical extent, the contact surface of the contact portions (major face brought in contact with a counterpart terminal) is exposed from the wall surface of the housing. In addition, the retained portions are secured by the housing such that their entire peripheral surface is covered.

The ground plate is disposed on the side opposite to the contact surface of the contact portions of said terminals (major face brought in contact with a counterpart terminal). Said ground plate is brought in contact with the ground terminals using ground contact portions protruding toward said ground terminals at locations corresponding to the ground terminals, thereby obtaining an improved shielding effect.

PRIOR ART LITERATURE

Patent Documents

[Patent Document 1] Japanese Patent No. 6198712

SUMMARY OF THE INVENTION

Problems to be Solved

Generally speaking, electrical connectors for circuit boards are often required to have a low profile, in other words, to be compact in the direction of connection with a counterpart connector. On the other hand, to maintain the stability of contact with counterpart terminals, the vertical dimensions of said contact portions need to be increased so as to expand the area of contact of the contact portions. To satisfy the requirements relating to the low profile of the connector and to the vertical dimensions of the contact portions, it is envisaged that the vertical dimensions of the retained portions could be reduced and the contact portions could be used as retained portions.

Incidentally, along with exposing the contact surface in the above-mentioned contact portions of the ground terminals throughout its entire vertical extent as discussed before, the surface on the side opposite to the contact surface also needs to be exposed to provide contact with the ground contact portions of the ground plate. Therefore, when the contact portions of the ground terminals are used as retained portions, the contact portions are secured by the housing using only the two lateral edges of said contact portions. However, when the contact portions are secured in this manner using only their two lateral edges, there is a risk that the contact portions, when subject to contact pressure from the ground contact portions, could disengage from the housing and lose contact with the counterpart terminals.

In view of these circumstances, it is an object of the present invention to provide an electrical connector for circuit boards which, along with increasing the dimensions of the contact portions of the terminals in the direction of connection of the connector and ensuring a low profile for the connector, can reliably prevent the contact portions of the ground terminals from coming off from the retainer and can maintain an excellent state of contact with the counterpart terminals.

Technical Solution

There is a need to provide an electrical connector for circuit boards which, along with increasing the dimensions of the contact portions of the terminals in the direction of connection of the connector and ensuring a low profile for the connector, can reliably prevent the contact portions of the ground terminals from disengaging from the retainer and maintain an excellent state of contact with counterpart terminals. The electrical connector for circuit boards according to the present invention is disposed on a mounting face of a circuit board and has a counterpart connector connected thereto in a direction of connection perpendicular to said mounting face.

Such an electrical connector for circuit boards, in the present invention, is characterized by the fact that there are provided multiple sheet metal terminals extending in the above-mentioned direction of connection and arranged in a single array direction parallel to the above-mentioned mounting face, a sheet metal ground plate disposed extending in the above-mentioned array direction throughout the array range of the terminals, and a retainer of an electrically insulating material securing in place the above-mentioned multiple terminals and the above-mentioned ground plate, and that the above-mentioned terminals have a connecting portion, which is formed at one end in the above-mentioned direction of connection and is connected to the above-mentioned mounting face, and a contact portion, which is formed at the other end in the above-mentioned direction of connection and has a contact surface brought in contact with a counterpart terminal; the above-mentioned ground plate has resilient strips brought in contact with the above-mentioned terminals; said resilient strips are formed within the range of the above-mentioned contact portions in the above-mentioned direction of connection at locations corresponding to the above-mentioned terminals in the above-mentioned array direction, and are brought in contact with the surface of said terminals on the side opposite to the above-mentioned contact surface; and the above-mentioned terminals have retained portions that extend from the lateral edges of the above-mentioned contact portions extending in the above-mentioned direction of connection and that are secured in place by the above-mentioned retainer.

As described above, as a result of bringing the resilient strips of the ground plate in contact with the surface on the side opposite to the above-mentioned contact surface, the contact portions of the terminals are subject to contact pressure from said resilient strips. In the present invention, the terminals have retained portions extending from the lateral edges of the above-mentioned contact portions in the above-mentioned direction of connection throughout the range of the contact portions, and are secured in place by the retainer with the help of said retained portions. Consequently, the contact portions are not prone to disengage from the retainer because the contact portions are more rigidly secured in place than when they are secured using only their two lateral edges.

In the present invention, the above-mentioned retained portions of the above-mentioned terminals may be bent at the lateral edges of the above-mentioned contact portions in the through-thickness direction of said terminals and may extend toward the above-mentioned ground plate. As a result of configuring the above-mentioned retained portions in the above-mentioned manner, the size of the terminals in the array direction is not increased and the connector can be made more compact in the terminal array direction by arranging paired terminals in a closely spaced manner.

In the present invention, the above-mentioned multiple terminals may be unitary co-molded with the above-mentioned retainer and secured in place by said retainer. As a result, the retained portions of the terminals are rigidly secured in place via unitary co-molding with the retainer.

In the present invention, the above-mentioned retained portions of the above-mentioned terminals may have formed therein openings passing therethrough in the through-thickness direction of said retained portions. In this manner, as a result of forming the openings in the retained portions, when the terminals are secured via unitary co-molding with the retainer, molten electrically insulating material flows into and hardens in the openings of the retained portions, thereby rigidly securing the retained portions in place.

In the present invention, in which a single connector element is formed of the above-mentioned multiple terminals, the above-mentioned ground plate, and the above-mentioned retainer, the multiple connector elements, which are arranged in a direction that is parallel to the above-mentioned mounting face and perpendicular to the above-mentioned array direction, may be adapted to be collectively secured in place by a support.

Technical Effect

Since in the present invention, as described above, the retained portions of the terminals secured in place by the retainer are formed extending from the lateral edges of the contact portions of said terminals, the retained portions of the terminals are positioned overlapping with the contact portions in the direction of connection of the connector, thereby obtaining a low profile for the connector while ensuring larger dimensions for the contact portions, in other words, a larger surface area of contact in the above-mentioned direction of connection. In addition, since the retained portions of the ground terminals are rigidly secured by the retainer, the contact portion can be adequately prevented from disengaging from the retainer even if the contact portions are subject to contact pressure from the resilient strips of the ground plate and an excellent state of contact with the counterpart terminals can be maintained.

DETAILED DESCRIPTION

Embodiments of this invention will be described below with reference to the accompanying drawings.

Figure 1:
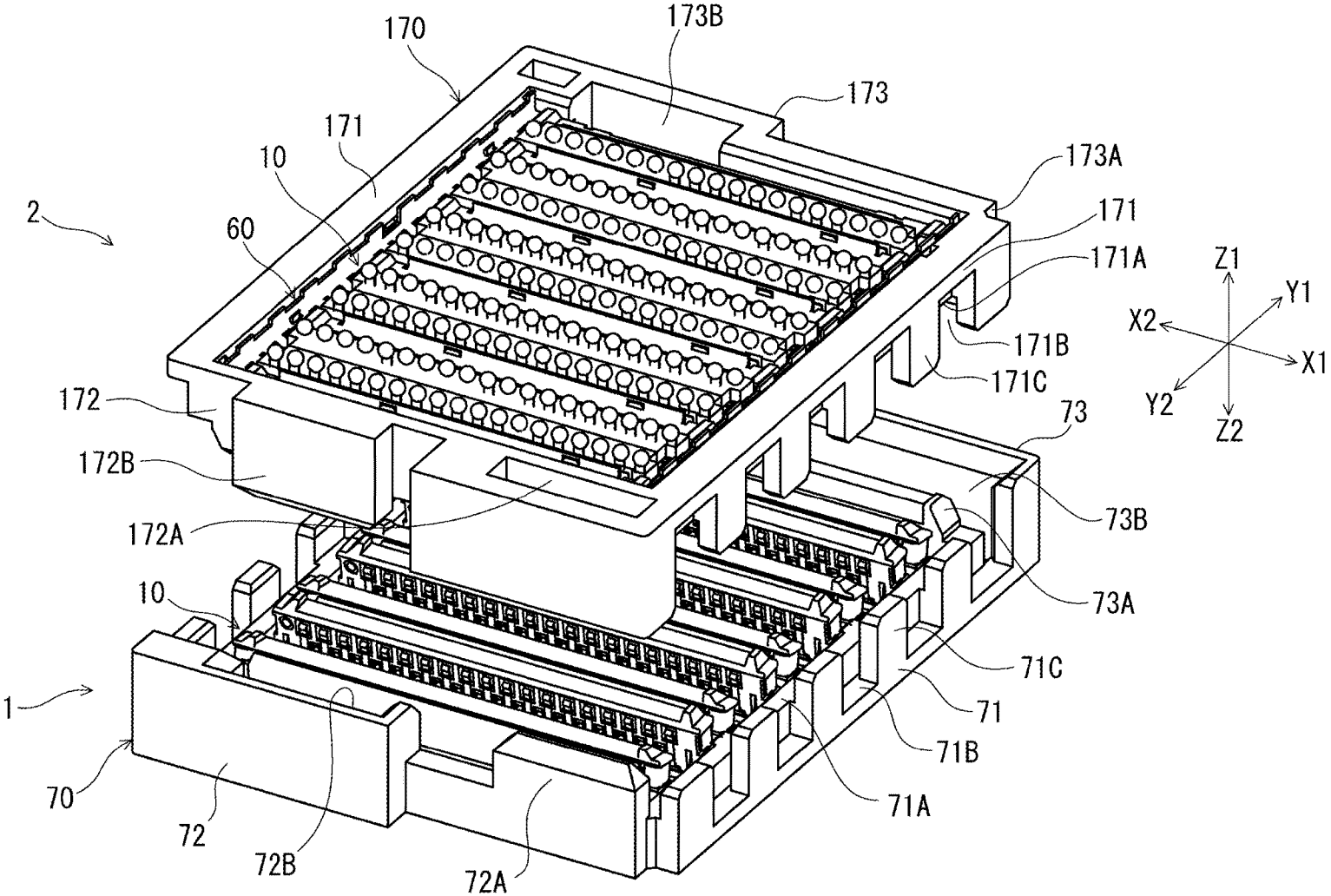
FIG. 1 An overall oblique view illustrating a state prior to mating a connector and a counterpart connector according to an embodiment of this invention.
Figure 2:
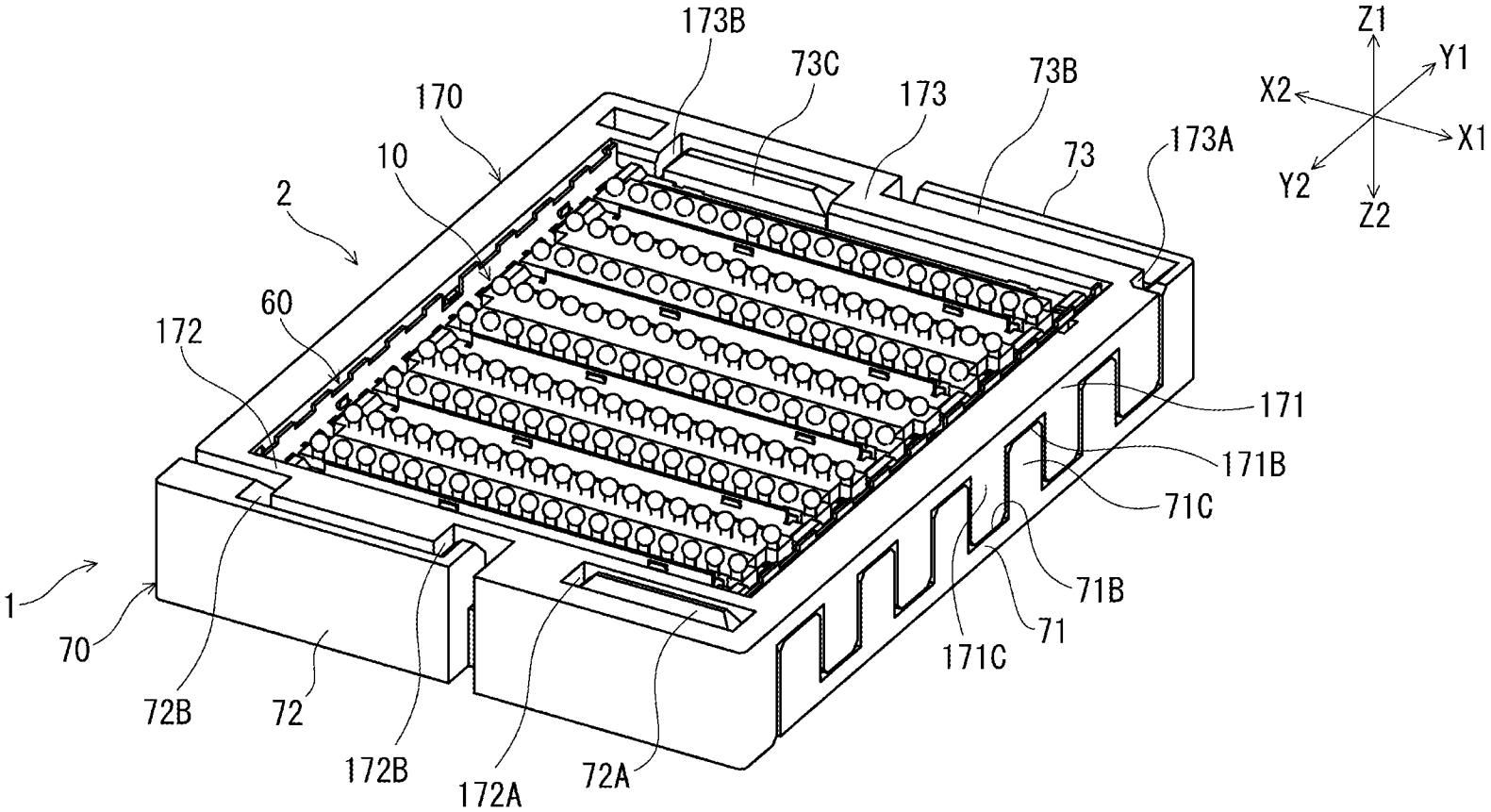
FIG. 2 An overall oblique view illustrating a state after mating the connector and counterpart connector of FIG. 1.
Figure 3:
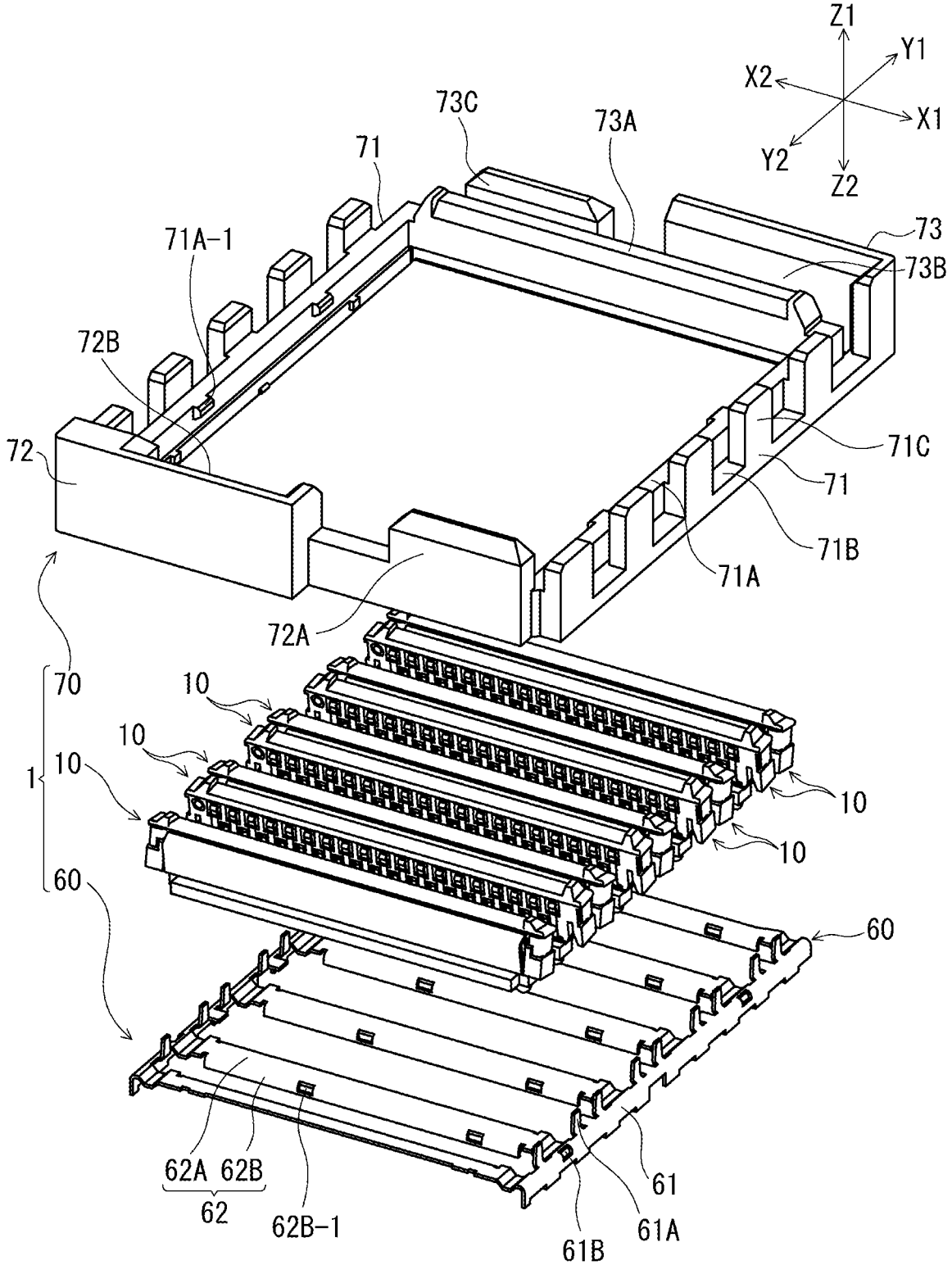
FIG. 3 An oblique view of the connector of FIG. 1 shown separated into a support, connection elements, and a coupling member.

FIG. 1 and FIG. 2 are oblique views illustrating the connector 1 and counterpart connector 2 of this embodiment, wherein FIG. 1 illustrates the two connectors 1, 2 before mating and FIG. 2 after mating. FIG. 3 is an oblique view in which the connector 1 is shown separated into the hereinafter-described support, connection elements, and coupling member. Connector 1 and counterpart connector 2, which are electrical connectors for circuit boards disposed on the mounting faces of respective circuit boards (not shown), are matedly connected in a vertical direction of connection (direction Z in FIGS. 1, 2) that is perpendicular to said mounting faces in an orientation in which the mounting faces of said circuit boards are parallel to each other. The two connectors 1 and 2 have common elements. Since the oblique view of FIG. 1 illustrates some sections that are visible either only in connector 1 or only in counterpart connector 2, common elements will be described with reference to both connectors 1, 2 on an as-needed basis.

Connector 1 comprises: multiple (nine, in this embodiment) connection elements 10 (see FIG. 3), which have a substantially rectangular parallelepiped-like external configuration extending in a single longitudinal direction (Y-axis direction in FIGS. 1 to 3) parallel to the above-mentioned mounting face and are arranged such that said longitudinal direction is the array direction; a coupling member 60 of sheet metal extending in the above-mentioned array direction (Y-axis direction) throughout the array range of the above-mentioned multiple connection elements 10, which connects and secures in place said multiple connection elements 10 (see FIG. 3); and a support 70 made of an electrically insulating material, which has a frame-like shape that is substantially square when viewed in the vertical direction and which holds and supports the multiple connection elements 10 connected and secured in place by the above-mentioned coupling member 60.

Figure 4:
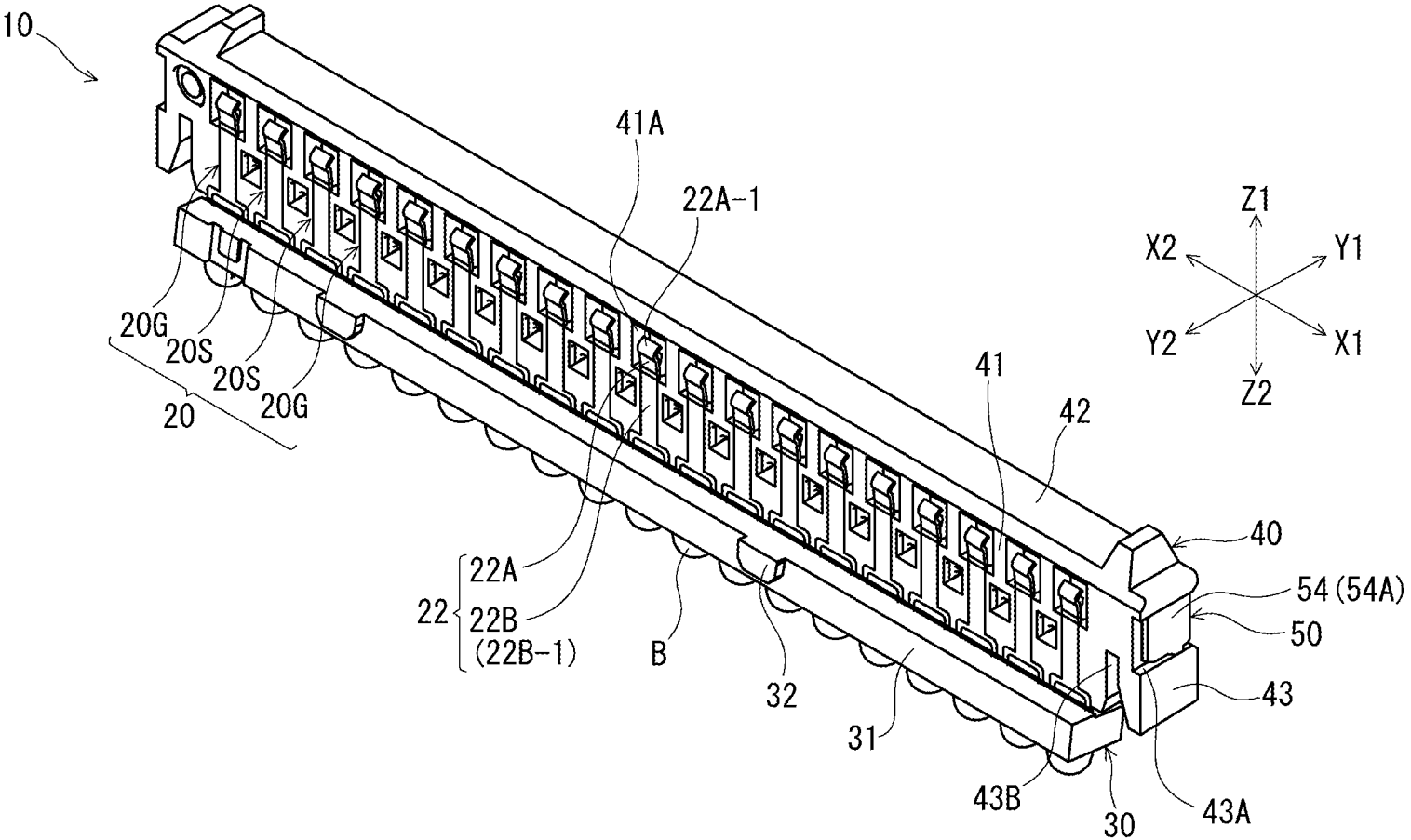
FIG. 4 An overall oblique view of a single connection element.

FIG. 4 is an overall oblique view illustrating a single connection element 10. Said connection element 10 comprises: multiple sheet metal terminals 20, which are arranged such that the connector-width direction (X-axis direction), i.e., the transverse direction of connector 1, is the terminal array direction; two retainers (a stationary retainer 30 and a movable retainer 40, which are described below) made of an electrically insulating material, which secure said multiple terminals 20 in place in array form by unitary co-molding; and a sheet metal member 50, which is disposed extending over the terminal array range in the connector-width direction. As can be seen in FIG. 3, in this embodiment, a single connection element 10 is located at one end (side Y2) in this array direction (Y-axis direction) while other connection elements are provided in pairs of two symmetrically grouped connection elements 10.

Figure 7:
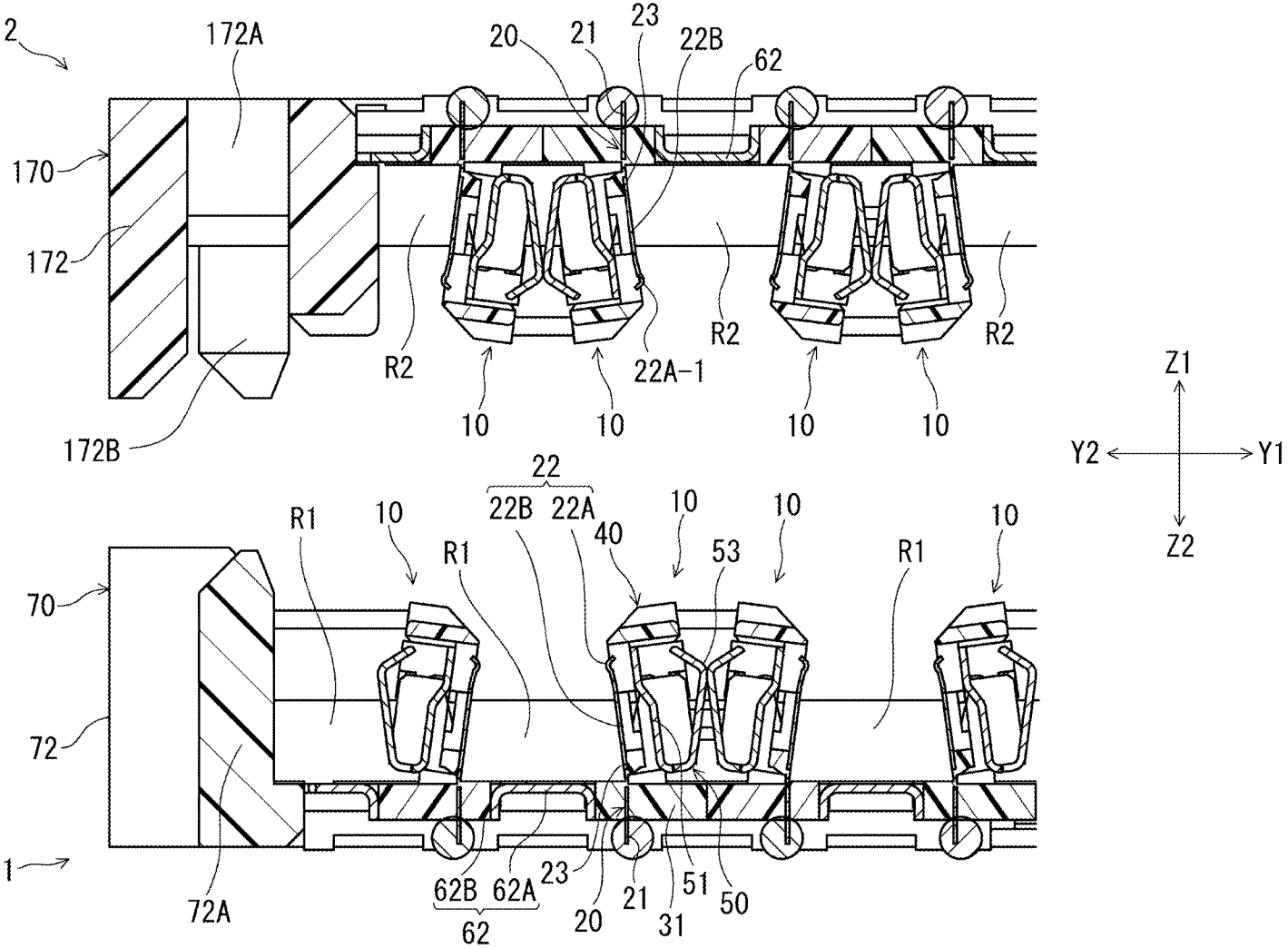
FIG. 7 A cross-sectional view of a portion of a connector and a counterpart connector prior to connector mating taken along a plane perpendicular to the connector-width direction, illustrating a cross-section at signal terminals in the connector-width direction.

In connector 1, spaces between two pairs of connection elements 10 adjacent in the above-mentioned array direction and, in addition, spaces between the connection elements 10 disposed at the outermost end positions in the above-mentioned array direction and the end walls 72, 73 of the support 70 are formed as receiving portions R1 used for receiving the connection elements 10 of counterpart connector 2 (see FIG. 7).

The retainers that secure the terminals 20 in place include a stationary retainer 30, which collectively secures in place the stationary-side retained portions 23B of all the terminals 20 provided in a single connection element 10 using unitary co-molding, and a movable retainer 40, which collectively secures in place the movable-side retained portions 23C and the upper retained portions 24 of all the above-mentioned terminals 20 using unitary co-molding and is capable of relative angular displacement with respect to the stationary retainer 30 such that the connector-width direction (X-axis direction) is the axis of revolution.

As can be seen in FIG. 4, when connector 1 is disposed on and connected to a circuit board, the stationary retainer 30 of connector 1, which is located closer to said circuit board, extends in the connector-width direction (X-axis direction) and, in addition, the movable retainer 40, which extends in parallel to said stationary retainer 30 in said connector-width direction, is provided spaced apart from the above-mentioned stationary retainer 30 in the vertical direction (i.e., in the height direction of the connector) at a higher location (on side Z1) positioned farther away from the above-mentioned circuit board than the stationary retainer 30. For example, as can be seen in FIG. 7, the vertical (Z-axis direction) dimensions of the stationary retainer 30 in a cross-sectional shape perpendicular to the connector-width direction are smaller than its width dimensions in the array direction (Y-axis direction) of the connection elements 10. By contrast, in the movable retainer 40, its dimensions in the vertical direction are larger than its width dimensions. The stationary retainer 30 and the movable retainer 40 will be discussed again below.

Figure 5:
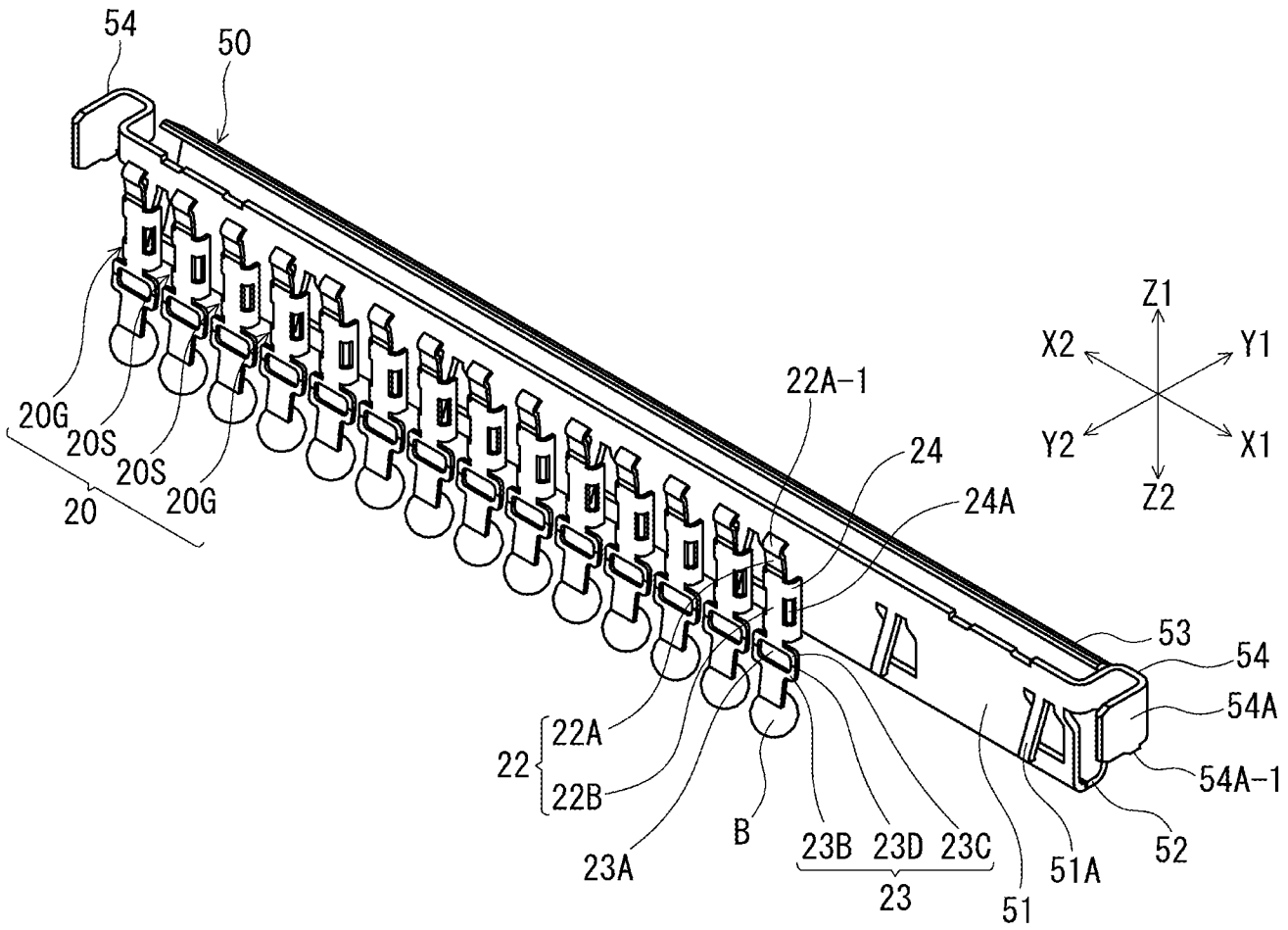
FIG. 5 An oblique view illustrating only the terminals and the sheet metal member of the connection element of FIG. 4.

FIG. 5 is an oblique view that illustrates only the terminals 20 and the sheet metal member 50 while omitting the stationary retainer 30 and the movable retainer 40 from the connection element 10 of FIG. 4. In addition, in this FIG. 5, some of the terminals 20 (several terminals 20 on side X1 in the connector-width direction) have been omitted to illustrate the hereinafter-described resilient strips of the sheet metal member 50. As can be seen in FIG. 5, the terminals 20 are obtained when metal strip-like pieces, which extend such that their longitudinal direction is a direction parallel to the vertical direction, are partially bent in the through-thickness direction, and their major faces (surfaces perpendicular to the through-thickness direction), excluding the hereinafter-described upper retained portion 24, are arranged extending in the connector-width direction. As can be seen in FIG. 7, said terminals 20 pass through the stationary retainer 30 in the vertical direction and are located on the lateral faces of the movable retainer 40 that form the outward lateral faces of a pair of connection elements 10 facing each other (in the X-axis direction), with the stationary retainer 30 and movable retainer 40 secured in place using unitary co-molding.

As can be seen in FIG. 4 and FIG. 5, in this embodiment, some terminals 20 among the multiple terminals 20 secured in place in array form by the connection elements 10 are used as signal terminals 20S while the remaining terminals 20 are used as ground terminals 20G. Said signal terminals 20S and said ground terminals 20G are arranged in a predetermined order. In this embodiment, the ground terminals 20G are adapted to be arranged on both sides of two adjacent signal terminals 20S, with paired high-speed differential signals transmitted by the above-mentioned two signal terminals 20S. Below, when the terminals 20 need to be described by distinguishing between the signal terminals 20S and ground terminals 20G, a letter "S" is attached to the reference numeral of each component of the signal terminals 20S and a letter "G" is attached to the reference numeral of each component of the ground terminals 20G.

As can be seen in FIG. 5, at their lower ends (at one end corresponding to Z2), said terminals 20 have connecting portions 21 that are solder-connected to the circuitry on the mounting face of the circuit board (not shown), and, at their upper ends (at the other end corresponding to Z1), they have contact portions 22 intended for contact with the hereinafter-described terminals 20 provided in counterpart connector 2. Moreover, in addition to the lower retained portions 23, which are secured in place by the stationary retainer 30 and the movable retainer 40 (see also FIGS. 6 and 7) between the connecting portions 21 and the contact portions 22, the terminals 20 also have upper retained portions 24 (see FIG. 5), which extend from the lateral edges in the vertical direction on both sides of the contact portions 22 and are secured in place by the movable retainer 40.

Figure 6:
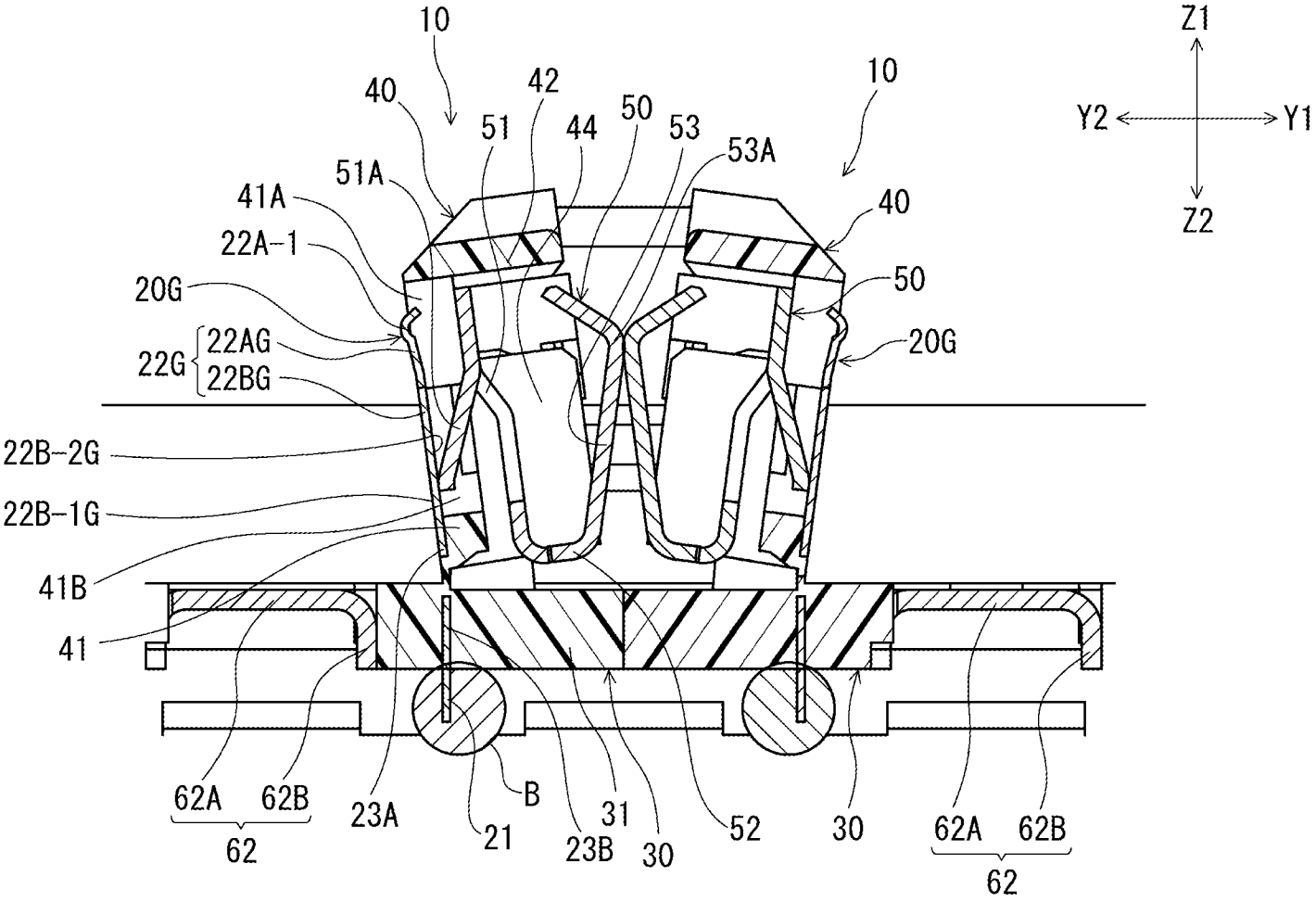
FIG. 6 A cross-sectional view of a pair of adjacent connection elements taken along a plane perpendicular to the connector-width direction, illustrating a cross-section of grounding terminals in the connector-width direction.

The connecting portions 21, which have a rectilinear configuration extending in the vertical direction, and, as can be seen in FIG. 6 and in FIG. 7, protrude from the bottom face of the stationary retainer 30, have attached thereto solder balls B used for solder connection to a circuit board.

Figure 8:
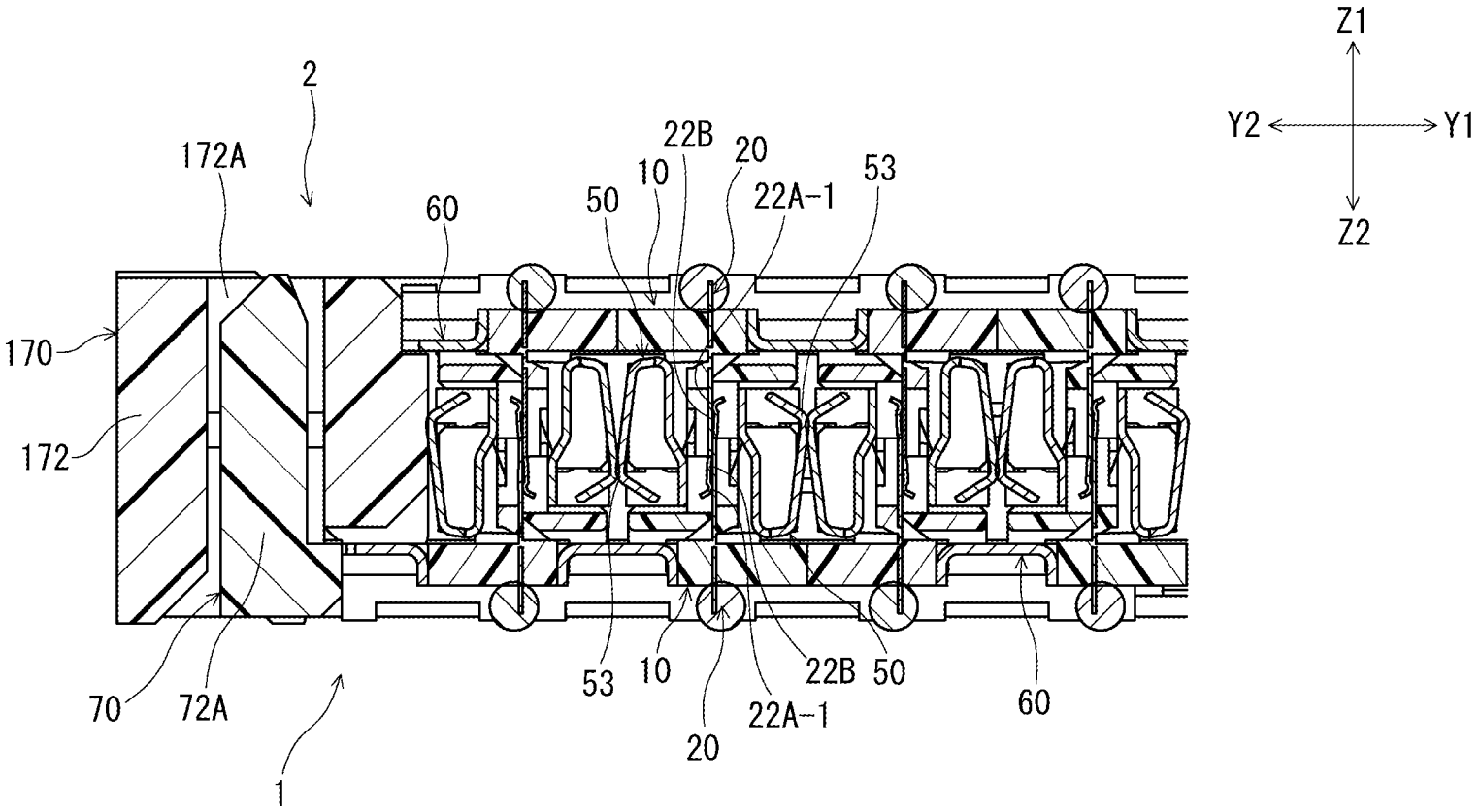
FIG. 8 A cross-sectional view illustrating the connector and counterpart connector of FIG. 7 in a state after connector mating.

As can be seen in FIG. 4, the contact portions 22 extend along one lateral face of the movable retainer 40 such that their major faces (faces perpendicular to their through-thickness faces) are exposed on the above-mentioned lateral face throughout its entire vertical extent. The exposed major faces serve as contact surfaces intended for contact with counterpart terminals. Specifically, said contact portions 22 have formed therein contact pieces 22A provided with convex contact point portions 22A-1 of a raised configuration at their upper ends as well as strip-shaped leaf contact point portions 22B located below said contact pieces 22A. As can be seen in FIG. 4, the above-mentioned contact pieces 22A are positioned in alignment with the hereinafter described openings permitting resilient displacement 41A of the above-mentioned movable retainer 40 and are capable of resilient displacement in the through-thickness direction. As can be seen in FIG. 8, the convex contact point portions 22A-1 of the terminals 20 of connector 1 are adapted to be brought in contact with the leaf contact point portions 22B of the terminals 20 (counterpart terminals) of counterpart connector 2, and the leaf contact point portions 22B of the terminals 20 of connector 1 are adapted to be brought in contact with the convex contact point portions 22A-1 of the terminals 20 (counterpart terminals) of counterpart connector 2. Shaping the contact portions 22 in this manner makes it possible to form an electrically simple rectilinear transmission path and improve transmission characteristics using a so-called stubless configuration.

In addition, as can be seen in FIG. 6, if the terminals 20 are used as grounding terminals 20G, the major faces on the side opposite to the contact surfaces 22B-1G of the leaf contact point portions 22BG of said grounding terminals 20G, as described below, serve as pressure surfaces 22B-2G brought in contact with said resilient strips 51A under the action of the pushing force of the resilient strips 51A of the sheet metal member 50.

As can be seen in FIG. 5, the lower retained portions 23 are formed to have a thicker width in the connector-width direction (X-axis direction) than the connecting portions 21 and the contact portions 22 and lower openings 23A, which pass therethrough in the through-thickness direction, are formed in their central area. Forming the lower openings 23A in this manner makes it possible for molten electrically insulating material to flow into and harden in said lower openings 23A when the lower retained portions 23 are unitary co-molded with the stationary retainer 30 and the movable retainer 40, thereby rigidly securing the lower retained portions 23 in place. In addition, the stationary retainer 30 and the movable retainer 40 overlap with the lower openings 23A within a certain range in the vertical direction, and the dimensions of said stationary retainer 30 and said movable retainer 40 in the vertical direction and, therefore, the dimensions of connector 1 in the vertical direction, are reduced according to the extent of the overlap, thereby providing for a low profile.

In addition, although in the present embodiment resin is adapted to flow into and harden in the lower openings 23A, as an alternative, for example, the stationary retainer 30 may be adapted to secure in place only the sections of the lower retained portions 23 that form the bottom edges of the lower openings 23A while the movable retainer 40 may be adapted to secure in place only the sections forming the top edges of the lower openings 23A. In such a retention configuration, the sections of the lower retained portions 23 located in the range of the lower openings 23A in the vertical direction are not secured in place by the stationary retainer 30 or by said movable retainer 40 and serve as resiliently displaceable flexible portions at an intermediate location between the stationary retainer 30 and said movable retainer 40. As a result, said flexible portions become larger and more prone to resilient displacement in the vertical direction, which makes it possible to ensure a larger extent of floating.

In the lower retained portions 23, their bottom halves constitute stationary-side retained portions 23B, which are secured in place by unitary co-molding with the stationary retainer 30, and their top halves constitute movable-side retained portions 23C, which are secured in place by unitary co-molding with the movable retainer 40. In addition, the sections located between the stationary-side retained portions 23B and the movable-side retained portions 23C in the lower retained portions 23 are not secured in place by the stationary retainer 30 or by the movable retainer 40. Said sections, which are made locally thinner than other portions, are formed as flexible portions 23D facilitating resilient flexure in the through-thickness direction (Y-axis direction) of said lower retained portions 23.

In the two lateral edges of the leaf contact point portions 22B of the above-mentioned contact portions 22, the upper retained portions 24 are bent toward the sheet metal member 50 and extend in the array direction (Y-axis direction) of the above-mentioned connection elements 10. As can be appreciated by comparing FIG. 4 and FIG. 5, the upper retained portions 24, being embedded within the thickness range of the movable retainer 40, are secured in place by unitary co-molding with said movable retainer 40. Said upper retained portions 24 have upper openings 24A passing therethrough in the through-thickness direction and formed at intermediate locations in the vertical direction. Thus, as a result of forming the upper openings 24A in this manner, when the upper retained portions 24 are unitary co-molded with the movable retainer 40, molten electrically insulating material flows into and hardens in said upper openings 24A, such that the upper retained portions 24 are rigidly secured in place.

As discussed before, if the terminals 20 are used as grounding terminals 20G, as can be seen in FIG. 6, the pressure surfaces 22B-2G (major faces on the side opposite to the contact surfaces 22B-1G) of the leaf contact point portions 22BG are acted upon by the pushing force of the resilient strips 51A of the sheet metal member 50. In the present embodiment, the upper retained portions 24G located within the range of said leaf contact point portions 22BG in the vertical direction are rigidly secured in place by the movable retainer 40, and, for this reason, said leaf contact point portions 22BG, which are acted upon by the pushing force of the above-mentioned resilient strips 51A, can be adequately prevented from disengaging from the movable retainer 40. As a result, an excellent state of contact can be maintained between the terminals 20 and the counterpart terminals (the terminals 20 of the counterpart connector 2).

In addition, since in the present embodiment the upper retained portions 24 secured in place by the movable retainer 40 are formed extending from the lateral edges of the leaf contact point portions 22B of said terminals 20, the upper retained portions 24 are positioned overlapping with the leaf contact point portions 22B in the vertical direction, thereby imparting a low profile to the connector while ensuring substantial dimensions for the leaf contact point portions 22B in the vertical direction, in other words, a substantial surface area that can be brought in contact with the counterpart terminals. Furthermore, since in the present embodiment the upper retained portions 24 are formed such that they are bent at the lateral edges of the leaf contact point portions 22B and extend toward the above-mentioned sheet metal member 50, the dimensions of the terminals 20 in the connector-width direction, in other words, the width dimensions of the terminals, are not increased and, as a result, the terminals 20 are closely spaced, which can make the connector more compact in the connector-width direction.

As can be seen in FIG. 4, the stationary retainer 30 has a stationary-side retaining portion 31, which extends in the connector-width direction (X-axis direction) and secures in place the stationary-side retained portions 23B of the terminals 20 (see FIG. 8) by unitary co-molding, and multiple protrusions 32 of a generally rectangular prismatic shape protruding from one lateral face (flat face located on side Y2 in FIG. 4 and perpendicular to the Y-axis direction) of said stationary-side retaining portion 31.

As can be seen in FIG. 4, the protrusions 32 are formed on the above-mentioned lateral face of the stationary-side retaining portion 31 at two locations spaced apart in the central area in the connector-width direction. Said protrusions 32 are adapted to be push-fitted into engagement openings 62B-1 in the hereinafter-described bottom plate portion 62 of coupling member 60 and engaged with said engagement openings 62B-1 in the vertical direction and in the connector-width direction.

As can be seen in FIG. 4, the movable retainer 40 is made larger than the stationary retainer 30 in the connector-width direction. Said movable retainer 40 has a plate-shaped movable-side retaining portion 41, which extends over the entire terminal array range in the connector-width direction, a top wall portion 42, which protrudes from the upper end of said movable-side retaining portion 41 in the array direction (Y-axis direction) of connection element 10 toward the sheet metal member 50 (side Y1 in connection element 10 of FIG. 4) and extends in the connector-width direction (see also FIG. 6), and mounting wall portions 43, which are located on both sides of the top wall portion 42 and the movable-side retaining portion 41 in the connector-width direction.

The movable-side retaining portion 41 has a plate-like configuration having major faces intersecting with the above-mentioned array direction, and, as can be seen in FIG. 4, secures in place the leaf contact point portions 22B and the upper retained portions 24 such that the contact surfaces 22B-1 (major faces) of said leaf contact point portions 22B of the terminals 20 are exposed on one major face in the above-mentioned array direction (major face on side Y2 in FIG. 4). In addition, the movable-side retaining portion 41 has formed therein openings permitting resilient displacement 41A, which pass through said movable-side retaining portion 41 in the through-thickness direction at locations corresponding to the contact pieces 22A of the terminals 20 in the connector-width direction and in the vertical direction. Said openings permitting resilient displacement 41A are adapted to permit resilient displacement of said contact pieces 22A in the through-thickness direction when the contact pieces 22 are brought in contact with counterpart terminals. In addition, in the movable-side retaining portion 41, resilient strip-receiving openings 41B, which extend throughout a range corresponding to the leaf contact point portions 22B of the terminals 20 in the vertical direction and pass through said movable-side retaining portion 41 in the through-thickness direction, are formed at locations corresponding to the terminals 20 below the above-mentioned openings permitting resilient displacement 41A (see FIG. 6). As can be seen in FIG. 6, said resilient strip-receiving openings 41B are openings intended to receive the hereinafter-described resilient strips 51A of the sheet metal member 50 at the location of the grounding terminals 20G. Said resilient strip-receiving openings 41B have one opening in the above-mentioned through-thickness direction sealed by the leaf contact point portion 22B of the terminal 20.

As can be seen in FIG. 4, at the upper ends of the mounting wall portions 43, the mounting wall portions 43 have formed therein mounting portions 43A, which are recessed into the exterior wall surfaces located on the outward sides in the connector-width direction (X-axis direction) and form recesses open to both sides of the connection element 10 in the array direction (Y-axis direction). As described below, the mountable portions 54 of the sheet metal member 50 are adapted to be press-fitted into said mounting portions 43A in the above-mentioned array direction (see FIG. 4). In addition, at locations inward of the above-mentioned mounting portions 43A in the connector-width direction, the mounting wall portions 43 have formed therein slit-like groove portions 43B open downwardly and to both sides in the above-mentioned array direction. As described below, said groove portions 43B are adapted to receive the upright pieces 61A of the coupling member 60 from below. In addition, they are not limited to the above-mentioned recesses in the mounting portions and, for example, may be formed as openings that pass therethrough in the above-mentioned array direction.

In the movable retainer 40, a space formed by the movable-side retaining portion 41, the top wall portion 42, and the mounting wall portions 43 is formed as a holding portion 44 used to hold part of the sheet metal member 50 (see FIG. 6).

As can be seen in FIG. 5, the sheet metal member 50 is made by bending a metal sheet in the through-thickness direction thereof and has a ground portion (ground plate) 51, which serves as a parallel plate portion extending in the connector-width direction and in the vertical direction; a curved portion 52, which is bent and folded back upwardly at the bottom edge of said ground portion 51; a plate-shaped biasing portion 53, which extends upwardly from said curved portion 52 along the above-mentioned ground portion 51 and faces said ground portion 51; and mountable portions 54 extending from the top portion of the ground portion 51 on both sides.

The ground portion 51 extends over the entire range of the terminal array in the connector-width direction as can be seen in FIG. 5 and, at the same time, extends over a range that includes all the contact portions 22 of the terminals 20 in the vertical direction as can be seen in FIG. 6, and is held within the holding portion 44 of the movable retainer 40 (see FIG. 6). Thus, the ground portion 51 disposed across the terminal array range serves also as a shielding plate. In addition, as can be seen in FIG. 6, said ground portion 51 is bent in the through-thickness direction in a substantially crank-like configuration, and in the array direction of the connection elements 10, its top portion is in close proximity to the movable-side retaining portion 41 of the movable retainer 40 and its bottom portion is spaced apart from said movable-side retaining portion 41. As can be seen in FIG. 6, the above-mentioned top portion of the ground portion 51 is formed in the vertical direction in a range that comprises the convex contact point portions 22A-1 of the terminals 20.

In addition, as can be seen in FIG. 5, at locations corresponding to the ground terminals 20G in the connector-width direction, the ground portion 51 has formed therein resilient strips 51A intended to contact with the pressure surfaces 22B-2G (see FIG. 6) of said ground terminals 20G. Said resilient strips 51A are formed by cutting out and raising sections of the ground portion 51 toward the terminals 20, thereby forming cantilevered tongues that extend downward at an incline toward the terminals 20. As can be seen in FIG. 6, said resilient strips 51A enter and extend into the resilient strip-receiving openings 41B of the movable-side retaining portion 41, and are brought in contact with the pressure surfaces 22B-2G of the ground terminals 20G at their lower ends while applying contact pressure thereto. In addition, the above-mentioned resilient strips 51 are not limited to the locations shown in FIG. 5 and can be formed at any location in the connector-width direction, and the terminals 20 provided in alignment with the locations of said resilient strips 51 are used as ground terminals 20G. In other words, ground terminals 20G can be selectively configured among the multiple terminals 20.

As can be seen in FIG. 6, after extending upward at an incline while moving away from the ground portion 51, the biasing portion 53 is bent back toward the ground portion 51 at a location proximal its upper end, and its distal end (free end) is positioned within the holding portion 44 of the movable retainer 40. The bent section forms a biasing protrusion 53A protruding toward the side opposite to the ground portion 51 and, as can be seen in FIG. 6, in a connected state, as described below, the biasing portions 53 provided in adjacent connection elements 10 push against each other with two biasing protrusions 53A, as a result of which their reaction force brings the contact portions 22 of the terminals 20 in contact with the terminals 20 (counterpart terminals) of counterpart connector 2 while applying contact pressure thereto.

As can be seen in FIG. 5, after having been bent in the top portions of the lateral edges located on both sides of the ground portion 51 in the connector-width direction toward the biasing portion 53 and extended in the above-mentioned array direction, the mountable portions 54 are then formed by being folded back. Therefore, when viewed in the vertical direction, said mountable portions 54 are formed to have a U-shaped configuration open toward the terminals 20 (side Y2 in FIG. 5) in the array direction (Y-axis direction) of the connection element 10. In said mountable portions 54, plate portions located on the outward sides in the connector-width direction, that is, plate portions extending toward the terminals 20 in the above-mentioned array direction, serve as mountable plate portions 54A that are press-fitted into the mounting portions 43A of the movable retainer 40 in the above-mentioned array direction and are secured in place therein (see also FIG. 4). Said mountable portions 54A have press-fit projections 54A-1 formed at the bottom edge thereof, with said press-fit projections 54A-1 adapted to enter the bottom interior wall surface of the mounting portions 43A when press-fitted into the mounting portions 43A. In this manner, in the present embodiment, press-fitting the mountable plate portions 54A of the sheet metal member 50 into the mounting portions 43A of the movable retainer 40 in the above-mentioned array direction allows for said sheet metal member 50 to be readily mounted to the movable retainer 40.

As can be seen in FIG. 3, the coupling member 60 is formed by bending a sheet metal member in the through-thickness direction and has two lateral plate portions 61 that extend in the array direction of the connection elements 10 and multiple bottom plate portions 62 that extend in the connector-width direction and couple said two lateral plate portions 61.

As can be seen in FIG. 3, the lateral plate portions 61 are positioned in alignment with the two ends of the connection elements 10 in the connector-width direction and have a plate-like configuration with major faces perpendicular to the connector-width direction. Said lateral plate portions 61 have upright pieces 61A rising upwardly from the top edges of said lateral plate portions 61 formed in the above-mentioned array direction at locations corresponding to the connection elements 10, with said upright pieces 61A adapted to enter the groove portions 43B (see FIG. 4) of the movable retainer 40 of the connection elements 10 from below. In addition, the lateral plate portions 61 have engagement openings 61B used for engaging with the engagement projections 71A-1 of the hereinafter-described support 70 formed at two locations in the above-mentioned array direction that pass through said lateral plate portions 61 in the through-thickness direction. The lateral plate portions 61 are disposed covering the lateral faces of the connection elements 10 and serve as shielding plates.

As can be seen in FIG. 3, FIG. 6, and FIG. 7, the bottom plate portions 62 are positioned in the above-mentioned array direction between pairs of connection elements (two paired connection elements) or between a single connection element 10 located at one end in the above-mentioned array direction (at the left end in FIG. 7) and the hereinafter-described first end wall 72 of the support 70. The thus disposed bottom plate portions 62 serve as shielding plates. Said bottom plate portions 62 have horizontal plate portions 62A whose major faces are perpendicular to the vertical direction, and vertical plate portions 62B, which are bent from the two lateral edges of said horizontal plate portions 62A extending in the connector-width direction and which extend downwardly. In other words, as can be seen in FIG. 7, the cross-sectional shape of the bottom plate portions 62 in a plane perpendicular to the connector-width direction has a downwardly open substantially inverted U-shaped configuration consisting of one horizontal plate portion 62A and two vertical plate portions 62B. However, as can be seen in FIG. 7, in the cross-sectional shape of the bottom plate portions 62 provided at the above-mentioned end in the above-mentioned array direction, the left half of the above-mentioned substantially inverted U-shaped bottom plate portions 62 is omitted.

As can be seen in FIG. 3, the vertical plate portions 62B have formed therein engagement openings 62B-1 used for engaging with the protrusions 32 of the stationary retainer 30 at two locations in the connector-width direction such that said openings pass through said vertical plate portions 62B in their through-thickness direction. As can be seen in FIG. 6 and in FIG. 7, the bottom plate portions 62 are located at the same height as the stationary retainer 30 in the vertical direction and the vertical plate portions 62B of said bottom plate portions 62 are located in close proximity to the lateral faces of the stationary retainer 30. The coupling member 60 is adapted to be mounted to the connector body 10 by engaging the engagement openings 62B-1 of the vertical plate portions 62B with the protrusions 32 of the stationary retainer 30.

The support 70 has a square frame-like configuration when viewed in the vertical direction, as can be seen in FIG. 3, and has two lateral walls 71 that extend in the array direction of the connector elements 10 and end walls 72, 73 (a first end wall 72 and a second end wall 73) that extend in the connector-width direction and couple the ends of said two lateral walls 71. As can be seen in FIG. 1, the inner half of the lateral walls 71 in the wall thickness direction (X-axis direction) of said lateral walls 71 has formed therein inner wall portions 71A that extend throughout the entire range in the array direction of the connector elements (Y-axis direction). In addition, as can be seen in FIG. 1, upwardly open recessed portions 71B recessed from the exterior surface of said lateral walls 71 are formed at spaced intervals at multiple locations in the above-mentioned array direction in the outer half of the lateral walls 71 in the wall thickness direction, and upwardly rising upright portions 71C are formed between adjacent recessed portions 71B. Said upright portions 71C extend to locations above the upper faces of the inner wall portions 71A. Engagement projections 71A-1 are formed in the top portion of the inner lateral faces of the inner wall portions 71A at locations corresponding to the engagement openings 61B of the lateral plate portions 61 of the coupling member 60. Said coupling member 60 is mounted to the support by engaging said engagement projections 71A-1 with the above-mentioned engagement openings 61B of the coupling member 60.

The end walls 72, 73 differ in shape from one another. As can be seen in FIG. 3, in the first end wall 72, which is located on side Y2 in the array direction (Y-axis direction) of the connector elements 10, the right half (section on side X1) in the connector-width direction (X-axis direction) is more thin-walled than the left half in the connector-width direction. The top half of said right half in the region on side X2 is cut away, as a result of which a first end wall protrusion 72A, which enters a first end wall recess 172A (see FIGS. 1 and 2) in the hereinafter-described support 170 of counterpart connector 2 during connector mating, is formed in the region on side X1. In the left half of the first end wall 72 (section on side X2), the interior wall surface in the region on side X1 in the connector-width direction is recessed and a first end wall recess 72B, which receives a first end wall protrusion 172B of the hereinafter-described support 170 of counterpart connector 2 during connector mating, is formed extending in the vertical direction.

As can be seen in FIG. 3, in the second end wall 73, the inner half (section on side Y2) in the wall thickness direction (Y-axis direction) of said second end wall 73 forms an inner wall portion 73A that extends in the connector-width direction. In the outer half (section on side Y1) of the second end wall 73, a second end wall recess 73B that extends in the vertical direction is formed in the right half (section on side X1) thereof in the connector-width direction, and the second end wall protrusion 173A of the hereinafter-described support 170 of counterpart connector 2 is adapted to be received into said second end wall recess 73B. The outer end surface (wall surface perpendicular to the Y-axis direction) of the left half (section on side X2) of the outer half of the second end wall 73 is located inwardly recessed (side Y2) in the above-mentioned array direction than the outer end surface of its right half, and a second end wall protrusion 73C is formed therein that protrudes above the inner wall portion 73A. Said second end wall protrusion 73C is adapted to enter the second end wall recess 173B provided in the second end wall 173 of the hereinafter-described support 170 of counterpart connector 2.

The connector 1 of this configuration is assembled in the following manner. First, a line of terminals 20 arranged in the connector-width direction are unitary co-molded with the stationary retainer 30 and the movable retainer 40 such that the terminals 20 are secured in place by said stationary retainer 30 and said movable retainer 40. Next, the sheet metal member 50 is mounted to said movable retainer 40 by press-fitting the mountable plate portions 54A of the sheet metal member 50 into the mounting portions 43A of the movable retainer 40 in the X-axis direction, thereby completing the assembly of a connector element 10. A plurality of said connector elements 10 are manufactured (nine in the present embodiment).

Next, the multiple connector elements 10 are mounted to the coupling member 60 from above. Specifically, along with inserting the upright pieces 61A of said coupling member 60 into the groove portions 43B of the movable retainers 40 of the connector elements 10 corresponding to said upright pieces 61A, the protrusions 32 of the stationary retainers 30 are engaged with the engagement openings 62B-1 of said coupling member 60.

Next, the support 70 is mounted to an assembly made up of the connector elements 10 and the coupling member 60 by placing the support 70 onto the above-mentioned assembly from above and engaging the engagement projections 71A-1 of the support 70 with the engagement openings 61B of the coupling member 60, thereby completing the assembly of the connector 1. In said connector 1, the support 70 supports multiple connector elements 10 with the help of the coupling member 60.

The configuration of the counterpart connector 2 will be discussed next. With the exception of the support, the construction of counterpart connector 2 is identical to connector 1. Namely, since the connector elements and the coupling member have the same shape as in connector 1, reference numerals identical to the reference numerals used for connector 1 will be assigned to said connector elements and coupling member and their description will be omitted, and the following discussion will focus primarily on the construction of the support.

The counterpart connector 2 is constructed such that an assembly in which connector elements 10 arranged in the same manner as in connector 1 are mounted to the coupling member 60 is supported by the hereinafter-described support 170. In said counterpart connector 2, the spaces between two pairs of connector elements 10 adjacent in the above-mentioned array direction, and, furthermore, the spaces between connector elements 10 disposed at the outermost end positions in the above-mentioned array direction and the hereinafter-described end walls 172, 173 of the support 70 are formed as receiving portions R2 intended for receiving the connector elements 10 of connector 1 (see FIG. 7).

As can be seen in FIG. 1, in the same manner as the support 70 of connector 1, the support 170 of counterpart connector 2 has two lateral walls 171 and two end walls 172, 173 (a first end wall 172 and a second end wall 173). In the same manner as the lateral walls 71 of connector 1, the lateral walls 171 have inner wall portions 171A, recessed portions 171B, and upright portions 171C. However, the position of the recessed portions 171B and upright portions 171C in the array direction (Y-axis direction) of the connector elements 10 is different from the support 70 of connector 1. Specifically, as can be seen in FIGS. 1 and 2, in the above-mentioned array direction, the recessed portions 171B of the support 170 are provided at the same locations as the upright portions 71C of the support 70 and the upright portions 171C of the support 170 are provided at the same locations as the recessed portions 71B of the support 70.

The two end walls 172, 173 differ in shape from one another. As can be seen in FIGS. 1 and 2, the right half (section on side X1) of the first end wall 172 in the connector-width direction has a configuration that can be mated with the right half of the first end wall 72 of connector 1, and the first end wall recess 172A, which can receive said first end wall protrusion 72A, is formed extending in the vertical direction at a location corresponding to the first end wall protrusion 72A of said first end wall 72. In addition, the left half (section on side X2) of the first end wall 172 in the connector-width direction has a configuration that can be mated with the left half of the first end wall 72 of connector 1, and the first end wall protrusion 172B, which can enter said first end wall recess 72B, is formed extending in the vertical direction at a location corresponding to the first end wall recess 72B of said first end wall 72.

As can be seen in FIGS. 1 and 2, the right half (section on side X1) of the second end wall 173 in the connector-width direction has a configuration that can be mated with the right half of the second end wall 73 of connector 1, and the second end wall protrusion 173A, which can enter said second end wall recess 73B, is formed extending in the vertical direction at a location corresponding to the second end wall recess 73B of said second end wall 73. In addition, the left half (section on side X2) of the second end wall 173 in the connector-width direction has a configuration that can be mated with the left half of the second end wall 73 of connector 1, and the second end wall recess 173B, which can receive said second end wall protrusion 73C, is formed extending in the vertical direction at a location corresponding to the second end wall protrusion 73C of said second end wall 73 (see FIG. 3).

Since the counterpart connector 2 is manufactured in the same manner as previously discussed with respect to connector 1, the manufacturing procedure used for counterpart connector 2 is not further discussed herein.

The operation of connector mating will be described next. First, the respective terminals 20 of connector 1 and counterpart connector 2 are respectively mounted to the mounting faces of the corresponding circuit boards (not shown). Specifically, the connecting portions 21S of the signal terminals 20S are solder-connected to signal circuitry and, furthermore, the connecting portions 21G of the ground terminals 20G are solder-connected to grounding circuitry.

In connector 1 and counterpart connector 2, as can be seen in FIG. 7, before connector mating, the terminals 20 of the connector elements 10 are bent at the flexible portions 23D (see FIG. 5) and said connector elements 10 are deflected in a section of the movable retainer 40 in the array direction of the connector elements 10 (X-axis direction) toward the receiving portions R1, R2.

Next, with the connector elements 10 still deflected in this section of the movable retainer 40, as illustrated in FIGS. 1 and 8, the counterpart connector 2 is placed above the connector 1, the connector elements 10 of said counterpart connector 2 are positioned directly above the receiving portions R1 of connector 1 and, at the same time, the connector elements 10 of connector 1 are positioned directly below the receiving portions R2 of counterpart connector 2. Said counterpart connector 2 is then lowered without changing its orientation. As said counterpart connector 2 is lowered, the connector elements 10 of said counterpart connector 2 enter the receiving portions R1 of connector 1 from above and, in addition, the connector elements 10 of connector 1 enter the receiving portions R2 of counterpart connector 2 from below.

In addition, in connector 1, a portion of the first end wall 172 of counterpart connector 2 enters a receiving portion R1 formed between the first end wall 72 and the connector element 10 located on the left end in FIG. 7 from above (see FIG. 8). Since in the present embodiment the distal end (free end) of the biasing portion 53 of the connector element 10 is located inside the holding portion 44 of the movable retainer 40 (see also FIG. 6), when the above-mentioned first end wall 172 enters the above-mentioned receiving portion R1, said first end wall 172 does not abut against the distal end of the biasing portion 53 from above and damage due to the buckling of said biasing portion 53 is reliably avoided.

Once the entry of the connector elements 10 into the receiving portions R1, R2 is completed, the mutually corresponding connector elements 10 become electrically connected. In other words, as can be seen in FIG. 8, along with bringing the convex contact point portions 22A-1 of the terminals 20 of connector 1 in contact with the leaf contact point portions 22B of the terminals 20 (counterpart terminals) of counterpart connector 2, the leaf contact point portions 22B of the terminals 20 of connector 1 are brought in contact with the convex contact point portions 22A-1 of the terminals 20 (counterpart terminals) of counterpart connector 2 under contact pressure.

Thus, under the action of the above-mentioned contact pressure, the terminals 20 of connector 1 and the terminals 20 of counterpart connector 2 are brought in contact while pushing against each other, and, as can be seen in FIG. 8, under the action of the reaction force generated between the terminals 20, the initial buckling in the flexible portions 23D of these terminals 20 in the respective connector elements 10 of connector 1 and counterpart connector 2 is reduced and the deflected orientation of the movable retainer 40 existing prior to connector mating is corrected.

At this point, adjacent pairs of connector elements 10 in connector 1 and counterpart connector 2 permit the above-mentioned correction of the orientation of the movable retainer 40 as a result of mutual application of pressure and resilient displacement by the biasing protrusions 53A of the respective biasing portions 53. The reaction force originating between said biasing portions 53 is balanced with the contact force due to the contact pressure between the contact portions of the terminals 20 (see FIG. 9). In addition, in the case of connector elements 10 located at the outermost end positions in the array direction of the connector elements 10, the biasing portions 53 use the biasing protrusions 53A to apply pressure to the interior wall surface of the end walls of the counterpart connector (counterpart connector 2 with respect to connector 1, and connector 1 with respect to counterpart connector 2) and undergo resilient displacement, thereby permitting correction of the orientation of the above-described movable retainer 40. Furthermore, the reaction force received by the biasing portions 53 from the interior wall surface of the above-mentioned end walls is balanced with contact force due to the contact pressure generated between the contact portions 22 of the terminals 20 (see FIG. 8).

As discussed before, in the present embodiment, the top portion of the ground portion 51 of the sheet metal member 50 is formed within a range comprising the convex contact point portions 22A-1 of the terminals 20 in the vertical direction, and is in close proximity to the movable-side retaining portion 41 of the movable retainer 40 (see also FIG. 6). Therefore, when the biasing portions 53 are acted upon by the above-mentioned reaction force, the major face of the above-mentioned top portion of the ground portion 51 is urged against the wall surface of the movable-side retaining portion 41. As a result, the contact pressure between the convex contact point portions 22A-1 located within said top portion and the leaf contact point portions 22B of the counterpart terminals is increased, and a stable state of contact between the terminals is adequately maintained.

In addition, in a mated state, as can be seen in FIG. 2, the upright portions 71C of the support 70 of counterpart connector 2 enter the recessed portions 71B of the support 70 of connector 1 from above and, at the same time, the upright portions 171C of the above-mentioned support 70 enter the recessed portions 171B of the above-mentioned support 170 from below, as a result of which the lateral walls 71 of the support 70 and the lateral walls 171 of the support 170 become engaged with one another in the array direction of the connector elements 10 and in the connector-width direction.

In addition, in a mated state, as can be seen in FIG. 2, the first end wall protrusion 72A and second end wall protrusion 73C of the support 70 of connector 1 enter, respectively, the first end wall recess 172A and second end wall recess 173B of the support 170 of counterpart connector 2 from below and, at the same time, the first end wall protrusion 172B and second end wall protrusion 173A of the support 170 of counterpart connector 2 enter, respectively, the first end wall recess 72B and second end wall recess 73B of the support 70 of counterpart connector 2 from above.

Figure 9:
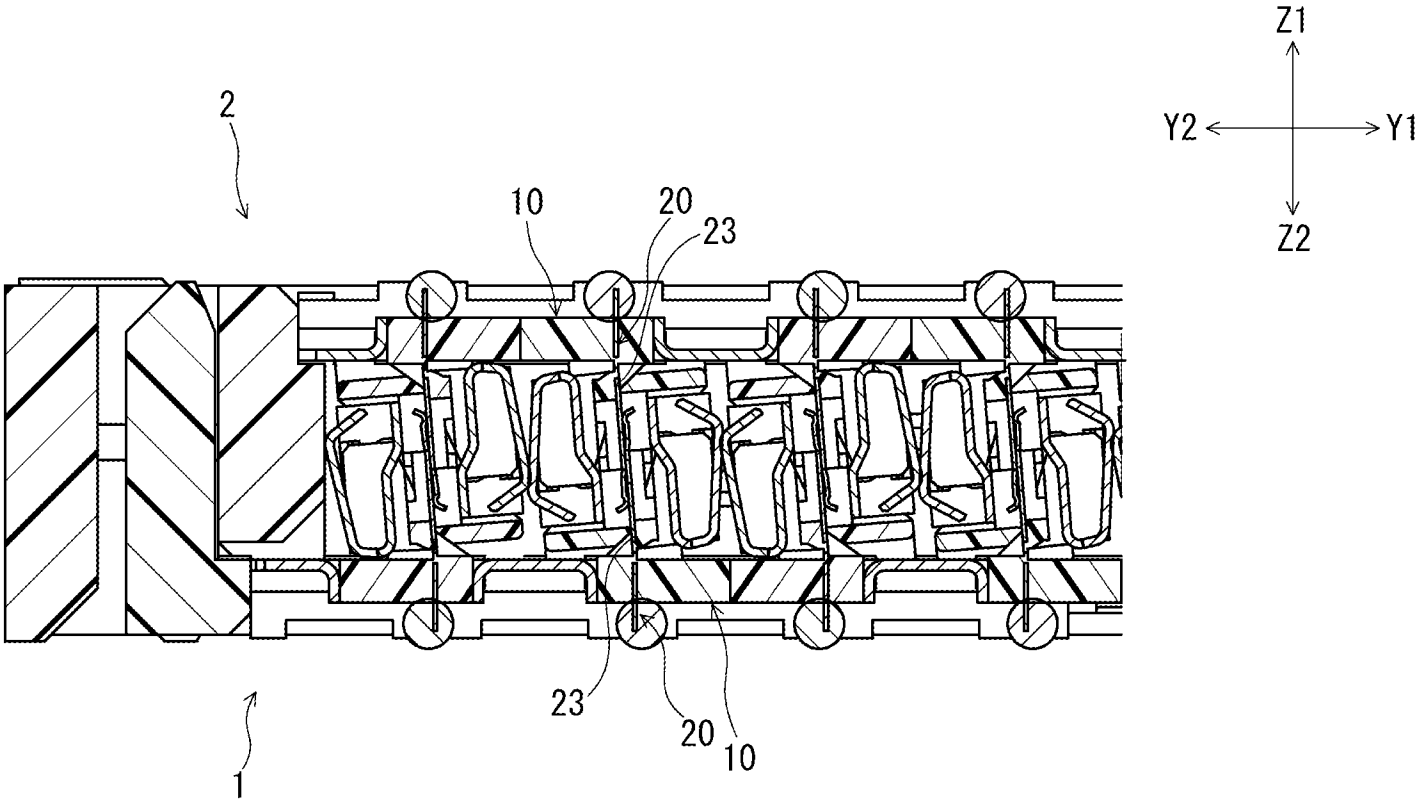
FIG. 9 A cross-sectional view illustrating the connector and counterpart connector of FIG. 7 in a state of floating.

In addition, after mating or before mating the connectors 1, 2, the respective circuit boards may be positioned with an offset from the regular position in the array direction of the connector elements 10. In such a case, in the present embodiment, two connector elements 10 that have contact pressure provided by the contact portions 22 of the terminals 20 maintain excellent contact between the contact portions 22 in a so-called "floating" state, wherein, as can be seen in FIG. 9, to the extent that the amount of the above-mentioned offset is canceled, flexure is generated in the flexible portions 23D (see FIG. 5) of the respective terminals 20 and this offset is absorbed.

Since in the present embodiment the contact portions 22 are positioned on one lateral face of the movable retainer 40 and the biasing portion 53 is provided on the other lateral face, with contact pressure ensured by being acted upon by biasing forces from the interior wall surfaces of the end walls of the supports 70, 170 or the biasing portion 53 of the sheet metal member 50 of another adjacent connector element 10, there is no need for the terminals 20 to protrude far from the movable retainer 40 in order to ensure contact pressure and the connector can be correspondingly imparted a lower profile.

Although in the present embodiment the ground portion of the sheet metal member is formed extending throughout the entire terminal array range in the connector-width direction, as an alternative, the ground portion may be formed to include only part of the terminal array range in the connector-width direction.

Although in the present embodiment the support 70 of connector 1 is formed in a shape different from that of the support 170 of counterpart connector 20, as an alternative, the supports of the two connectors may be formed in the same shape. In such a case both connectors will have substantially the same configuration.

DESCRIPTION OF THE REFERENCE NUMERALS

1 Connector
2 Counterpart connector
10 Connector element
20 Terminal
21 Connecting portion
22 Contact portion
23D Flexible portion
24 Upper retained portion (retained portion)
24A Upper opening (opening)
30 Stationary retainer
40 Movable retainer
43A Mounting portion
50 Sheet metal member
51 Ground portion (ground plate)
51A Resilient strip
53 Biasing portion
54 Mountable portion
70 Support
170 Support

The invention claimed is:

1. An electrical connector for circuit boards disposed on a mounting face of a circuit board and having a counterpart connector connected thereto in a direction of connection perpendicular to said mounting face, comprising:

multiple sheet metal terminals extending in the above-mentioned direction of connection and arranged in a single array direction parallel to the above-mentioned mounting face, a sheet metal ground plate disposed extending in the above-mentioned array direction throughout the array range of the terminals, and a retainer of an electrically insulating material securing in place the above-mentioned multiple terminals and the above-mentioned ground plate;

the above-mentioned terminals have a connecting portion, which is formed at one end in the above-mentioned direction of connection and is connected to the above-mentioned mounting face, and a contact portion, which is formed at the other end in the above-mentioned direction of connection and has a contact surface brought in contact with a counterpart terminal;

the above-mentioned ground plate has resilient strips brought in contact with the above-mentioned terminals;

said resilient strips are formed within the range of the above-mentioned contact portions in the above-mentioned direction of connection at locations corresponding to the above-mentioned terminals in the above-mentioned array direction and are brought in contact with the surface of said terminals on the side opposite to the above-mentioned contact surface; and the above-mentioned terminals have retained portions that extend from the lateral edges of the above-mentioned contact portions extending in the above-mentioned direction of connection and that are secured in place by the above-mentioned retainer.

2. The electrical connector for circuit boards according to claim 1, wherein the above-mentioned retained portions of the above-mentioned terminals are bent at the lateral edges of the above-mentioned contact portions in the through-thickness direction of said terminals and extend toward the above-mentioned ground plate.

3. The electrical connector for circuit boards according to claim 1, wherein the above-mentioned multiple terminals are unitary co-molded with the above-mentioned retainer and are secured in place by said retainer.

4. The electrical connector for circuit boards according to claim 3, wherein the above-mentioned retained portions of the above-mentioned terminals have formed therein openings passing therethrough in the through-thickness direction of said retained portions.

5. The electrical connector for circuit boards according to claim 1, wherein a single connector element is formed of the above-mentioned multiple terminals, the above-mentioned ground plate, and the above-mentioned retainer, and the multiple connector elements, which are arranged in a direction parallel to the above-mentioned mounting face and perpendicular to the above-mentioned array direction, are collectively secured in place by a support.

* * * * *